United States Patent [19]

Caldwell

[11] 4,350,138

[45] Sep. 21, 1982

[54] AXIALLY-SPLIT ARCHERY BOW LIMB

[76] Inventor: Joseph M. Caldwell, 2259 W. Big Tujunga Canyon, Tujunga, Calif. 91042

[21] Appl. No.: 174,544

[22] Filed: Aug. 1, 1980

[51] Int. Cl.[3] ..... F41B 5/00

[52] U.S. Cl. ..... 124/24 R; 124/86

[58] Field of Search ..... 124/22, 23 R, 24 R, 124/25, 88, 86, 90

[56] References Cited

U.S. PATENT DOCUMENTS 3,958,551 5/1976 Ketchum ..... 124/24 R 4,183,345 1/1980 Caldwell ..... 124/24 R

OTHER PUBLICATIONS

Jennings Compound Bow–Catalogue of Jennings Compound Bow, Inc.

1980 Pro Staff Catalog of Ben Pearson Archery, Inc., P.O. Box 7465, Pine Bluff, AR 71611 . . . pp. 4 and 7.

1980 Archery Catalog of Bear Archery, Inc., Rural Rt. 4, 4600 SW 41st Blvd., Gainsville, FL 32601–Cover, pp. 5, 7, 9 & 11.

1980 Catalog of Jennings Compound Bow, Inc., 28756 North Castaic Canyon Rd., Valencia, CA 91355 . . . Cover, pp. 7, 9, 13 & 16.

*Primary Examiner*—Richard C. Pinkham

*Assistant Examiner*—William R. Browne

*Attorney, Agent, or Firm*—Christie, Parker & Hale

[57] ABSTRACT

A limb for a compound archery bow has an inboard end and an outboard end at opposite sides of an elongate axis. The inboard end is adapted to be secured to a handle riser of the bow. The outboard end is forked to define an outward opening crotch for accomodating a pulley. The limb is split along its elongate axis from the inboard end of the crotch for a substantial portion of the length of the limb toward the mounting at the limb inboard end to divide the limb into two limb portions on opposite sides of the elongate axis. Cooperation is provided at at least one location along the limb for holding together the limb portions sufficiently so that, upon application of a limb flexing force to a pulley axle at the outboard limb end, the limb portions flex essentially as though the limb were unsplit along its length.

19 Claims, 15 Drawing Figures

101
102
103
105
107
109
111
112
113
114
115
118
122
123
125
127
128
130
131
132
133
134
135
137
138
140

AXIALLY-SPLIT ARCHERY BOW LIMB

BACKGROUND OF THE INVENTION

This invention pertains to archer's shooting bows. More particularly, it pertains to such bows in which a forked bow limb is split axially for a substantial portion of the length of the limb to divide the limb into two limb portions which, when the bow is drawn, flex together essentially as though the limb were unsplit along its length.

REVIEW OF THE PRIOR ART

Compound shooting bows use a bowstring rigged over eccentric pulleys. A pulley is mounted on an axle at the end of each bow limb. The bow limb is forked at its outer end to define a limb crotch to accomodate the pulley. The limb crotch tapers inwardly near the end of the limb and is typically V-shaped. When the bow string is drawn, force acting on the pulley axle causes the limbs to flex and the pulley to rotate.

Generally the limbs are fabricated of a material which is stronger along the length of the limb than across it. For greatest flexing strength, the interior of the limb is made up of incremental strips which run parallel to the length of the limb from its point of attachment at the handle riser of the bow to the other end of the limb receiving the pulley axle. For example, the grain in a wood limb follows the length of the limbs. Adjacent strips are held together by cohesive forces which are not as strong as the strips themselves. The limb is covered by reinforcing lamina, such as fiberglass, which has a similar grain structure to wood. The limb strips are strongest in the lengthwise direction; however, there is relatively little strength between the strips. The strips at the outer edges of the limb run the entire length of the limb to the pulley axle and directly receive the flexing stress when the bow is drawn. However, strips located in the middle area of the limb terminate somewhere along the limb crotch. These interior strips do not directly receive the limb flexing force and therefore have a tendency to resist flexing as the bow is drawn. Only the interstrip cohesive forces transfer stress to the interior strips from the outer incremental strips in response to the drawing force supplied to the pulley axle. Since the interfiber cohesive forces are not as strong as the strips themselves, the interior strips do not receive as much longitudinal bending stress as the outer strips. As a result the limb has a tendency to bow transversely of its width and to develop significant transverse tensional stresses which concentrate at the area where the crotch is deepest. The bow limb is inherently unstable and after repeated flexing, the concentrated transverse tensional stresses eventually tend to overcome the cohesive forces and cause separation of adjacent strips. A crack develops at the back of the limb near the end of the crotch.

Limb cracking tends to reduce the useful life of the bow and presents a safety hazard. A cracked limb cannot accommodate stress as readily as an uncracked limb. Once the transverse stress pattern causes the limb to crack, the crack rapidly propagates along the limb. There is a real possibility that a cracked limb may collapse when the bow is drawn and the pulley or broken limb fragments could injure the archer. Moreover, a cracked limb reduces the effective shooting weight of the bow and its useful range.

The prior art attempted to solve the problem of unbalanced stress distribution by applying a reinforcing patch to the back of the limb to cover the area near the bottom of the crotch. While the patch tended to resist cracking across the limb, it did not put the innerstrips under full bending load, nor did it relieve the unbalanced stress distribution. Although the limb was somewhat stronger, it may still be subject to cracking.

The prior art made another attempt to solve the aforementioned problem by installing a bolt or rivet in the limb at a point directly inboard of a narrowly tapered crotch. The narrow taper does not solve the problem since a significant number of strips still terminate at the crotch. The applied fastener strengthened the limbs somewhat, since a crack, if it developed, would tend to propagate to the fastener and stop there. However, since the fastener does not provide a uniform stress distribution throughout the limb, the limb is subject to further cracking inboard of the fastener and potential failure.

A third attempt to achieve uniform stress distribution involved a harness yoke for the deadend connection of the bus cables attached to the bow pulleys. The yoke is used with an arrow and cable guard for deflecting the bus cables from the shooting string at the nocking point. While the harness yoke and cable guard system is directed toward reducing but not solving the unrelated problem of eliminating objectionable torsional stresses acting on the pulley axle as the bow is drawn, it does not relieve the problem of unbalanced stress distribution along the length of the limb arising from limb strips' terminating at the limb crotch and not directly receiving the flexing force.

There is need for a limb for compound archery bows which effectively deals with the problem of undesirable stresses near the limb crotch. There is also need for a bow limb which has a uniform distribution of stress across the limb.

SUMMARY OF THE INVENTION

This invention provides an elongate, resilient limb for a compound archery blow, which has a limb crotch to accommodate a pulley and uniform distribution of stress across the limb. In particular, the limb defines an outboard limb end and an inboard limb end at opposite ends of an elongate limb axis.

The inboard limb end includes mounting means adapting that end to be secured to a handle riser of the archery bow. The outboard limb end is forked to define an outboard opening crotch between a pair of limb tips. The crotch comes to a taper across the elongate axis at a location along the limb which is intermediate the outboard and inboard limb ends. The limb tips define a passage for receiving an axle for mounting a pulley. The pulley axle is preferably perpendicular to the elongate axis of the limb.

The material of the limb is split along the elongate axis to divide the limb into two limb portions on opposite sides of the axis. The division is from the inboard end of the crotch for a substantial portion of the length of the limb toward the limb mounting means. The limb also includes means cooperating between the limb portions at at least one selected location along the limb portions. This cooperative means holds the limb portions together sufficiently so that, upon application of a limb flexing force to an axle received in the passage, the limb portions flex together essentially as though the limb were unsplit along its length. Other features and advantages of this invention will become apparent from the following detailed description and drawings.

DESCRIPTION OF THE DRAWINGS

The above-mentioned and other features of this invention are more fully set forth in the following detailed description of the presently preferred embodiments of this invention, which description is presented with reference to the accompanying drawings, wherein:

FIG. 8 is a plan view of another preferred bow limb, according to this invention;

FIG. 9 is a plan view of another preferred bow limb, according to this invention;

FIG. 12 is a side elevation of a compound bow using the cantilever-supported limb of FIG. 11, according to this invention;

FIG. 13 is a side elevation of the bow limb of FIG. 11;

FIG. 14 is a side elevation of the bow limb of FIG. 11 mounted to a bow as a cantilever-mounted bow limb, such as in FIG. 12;

DETAILED ANALYSIS OF THE PRIOR ART

A limb for a prior art compound shooting bow was elongated and had an inboard end secured to the handle riser and an outboard end at one tip of the bow. The limb was made of a material which is stronger along the length of the limb than across it. The limb material typically has a shear modulus in a plane normal to the elongate direction which is substantially greater than its shear modulus in a plane parallel to the elongate direction.

Figure 3:
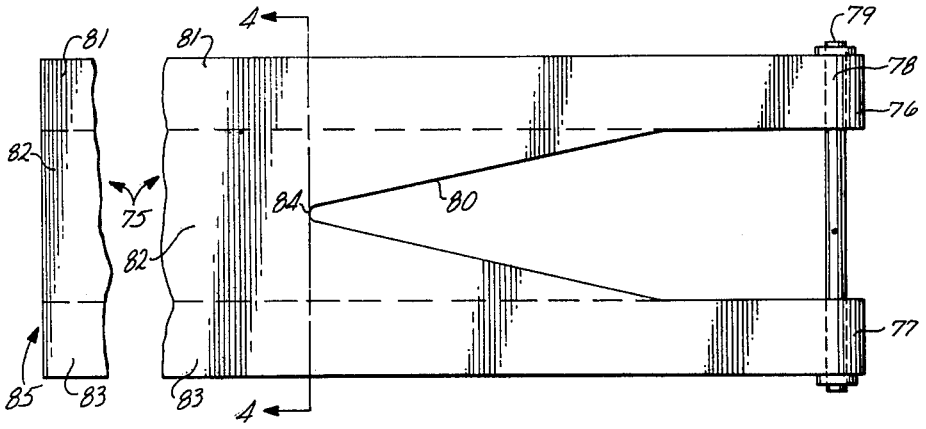
FIG. 3 is an enlarged plan view of the outboard end of a forked prior art bow limb for a compound shooting bow.

FIG. 3 is an enlarged plan view of the outboard end of a prior art limb 75. The limb is forked and defines outboard limb tips 76 and 77 and a pulley axle passage 78 for receiving a pulley axle 79 for mounting an eccentric pulley between the outboard limb tips. Limb 75 includes a tapered limb crotch 80 between the limb tips. The crotch opens outwardly for accomodating the pulley and has an inboard end at an intermediate location 84. The limb includes an inboard end 85 which is adapted to be secured to a handle riser of the bow.

The forked geometry functionally divides the limb into three lengthwise segments 81, 82 and 83, as shown in FIG. 3. Segment 81 comprises that portion of the limb material which runs uninterrupted from the inboard end 85 of the limb to the pulley axle passage 78 at one of the limb tips. Limb segment 83 is similarly defined. The middle limb segment 82 comprises that part of the limb material which terminates in the limb crotch 80 and does not extend to the pulley axle passage. When the limb is at rest, and the bow is not drawn, limb segments 81, 82 and 83 are coplanar in cross section.

Figure 4:
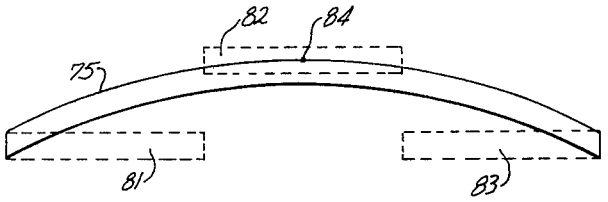
PRIOR ART FIG. 4
FIG. 4 is a cross-section view taken along line 4—4 in FIG. 3.

FIG. 4 is a cross-section view of the limb 75 in a stressed condition (i.e., when the bow is drawn), taken along line 4—4 in FIG. 3. The result of the prior art arrangement shown in FIG. 3 is the imposition of substantial unbalanced stressing on the limbs at full draw of the bow. The effect of such unbalanced stressing is exaggerated for purposes of illustration in FIG. 4, where limb 75 is bowed across its width, i.e., in the transverse direction. The rectangles shown in ghost outline in FIG. 4 correspond to a hypothetical configuration of limb segments 81–83 if each limb segment could flex independently of the others when the bow is drawn, i.e. if there were no interstrip cohesive forces binding incremental limb strips together between segments 81, 82 and 83. As defined, limb segments 81 and 83 on the outer edges of the limb comprise material that runs uninterrupted in the longitudinal direction from the inboard end of the limb to the pulley axle passage. This material directly receives the drawing force of the bow acting through the pulley axle and transmitted to the limb at the axle passage.

In FIG. 4, limb segments 81 and 83, if they could flex independently of limb segment 82, would flex fully and would not transversely bow during flexing of the limb. These sections would lie in a common plane and be vertically displaced from their positions when the bow is at rest. On the other hand, the middle limb segment 82 comprises material which does not extend to the axle passage but terminates at some location along the tapered limb crotch 80. The material located within middle segment 82 does not directly receive the limb flexing force and tends to resist flexing when the bow is drawn. If the middle segment could act independently of sections 81 and 83, it would not flex when the bow were drawn. Thus, in FIG. 4, limb segments 81 and 83, which flex in response to drawing of the bow, are vertically displaced from the middle segment 82, which remains in its at-rest position. Although the middle limb segment 82 resists flexing, the limb does not shear into three distinct segments 81, 82 and 83 because of the existence of cohesive forces binding adjacent limb strips. Thus, the bow limb illustrated in FIG. 3 will exhibit unbalanced limb deflection, manifested by bowing or flexing in the transverse direction, in response to drawing of the bow string and application of limb-flexing force to 78.

The structure analyzed in FIGS. 3 and 4 creates several problems in an archer's bow. The unbalanced stresses are substantial and cause a bow limb, which is designed to flex only in the longitudinal direction, to flex objectionably in the transverse direction. The interstrip cohesive forces tend to accommodate compression more readily than shear or tension. For these reasons, the limb of FIG. 3 will develop significant and concentrated tensional stressing near the inboard end of the limb crotch on the convex face of the transversely bowed limb. Repeated flexing of the limb eventually tends to cause a crack to form inboard of the crotch which reduces the ability of the limb to further accommodate stress. Once a crack develops, it will tend to propagate rapidly along the length of the limb with a concomitant danger of sudden bow failure. For these reasons, there is need for a solution to the problem of transverse tensional stress and unbalanced deflection of bow limbs without the disadvantages of previously used or described solutions.

DESCRIPTION OF THE ILLUSTRATED EMBODIMENT

Figure 1:
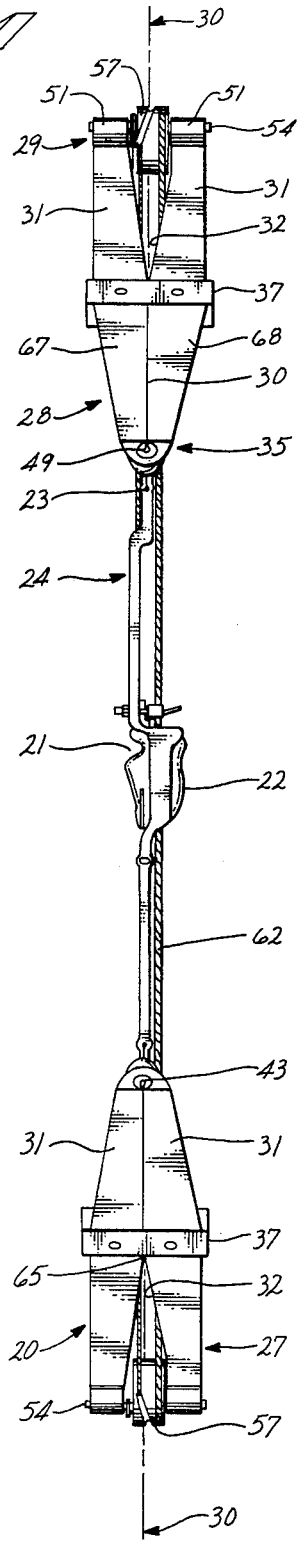
FIG. 1 is a back elevation of a compound bow, using an intermediately pivoted limb, according to this invention.
Figure 2:
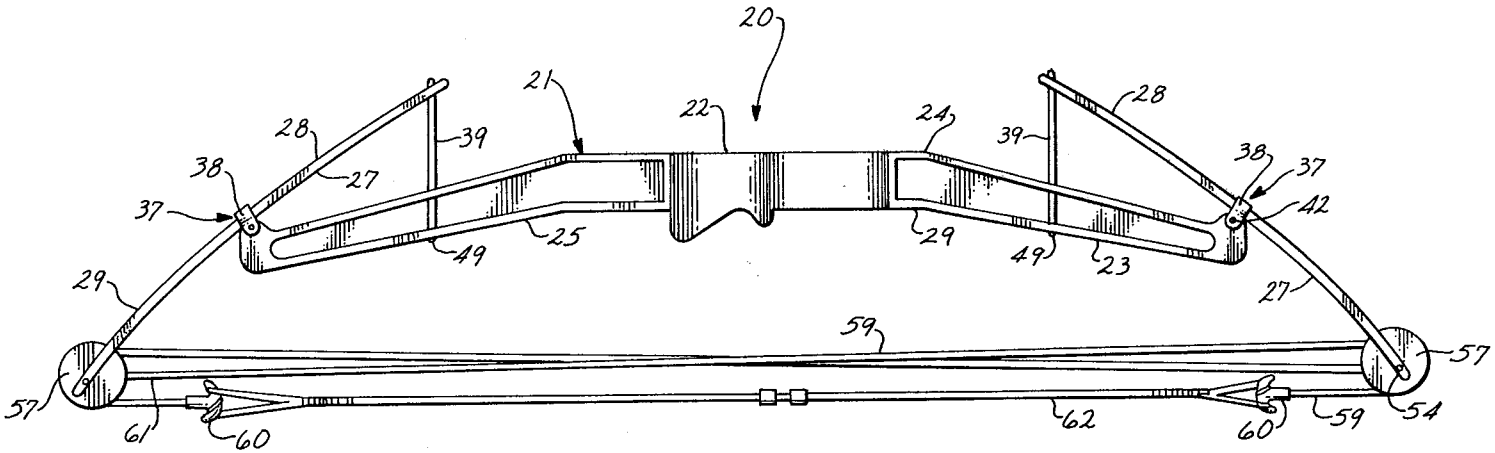
FIG. 2 is a side elevation view of the bow shown in FIG. 1.

An archer's compound shooting bow 20 is shown in FIGS. 1 and 2 and includes an elongate rigid handle riser assembly 21 which defines a handle 22 centrally between the opposite ends 23 of the riser assembly. The bow is shown in back view in FIG. 1 and in side elevation in FIG. 2. The riser assembly has a back face 24 which is of generally convex configuration and a concave front face 25. Handle 22 is adapted to be engaged in and supported by a hand of the user of the bow. The riser assembly can be built up out of wood or it can be defined by either a metal casting of a fabricated metal structure.

A pair of substantially identical elongate resilient limbs 27, flexible in bending and in torsion, are also components of bow 20. A limb is disposed at each end 23 of the riser assembly. The limbs define an inboard limb end 28 at the end of the riser assembly and an outboard limb end 29 at the end of the bow. The inboard limb end and the outboard limb end are at opposite ends of an elongate limb axis 30. The limb axis divides the limb into two limb portions 31 on either side of the limb axis.

The inboard limb end 28 includes mounting means 35 adapting the inboard limb ends to be secured to the handle riser. The bow illustrated in FIGS. 1 and 2 uses intermediately pivoted limbs, such as are shown in U.S. Pat. No. 4,183,345, in which this invention is believed to have increased significance. Each limb is hingeably pivoted relative to the handle assembly at an intermediate limb location 37 by a pivot 38. This hinging connection of each limb to the riser assembly is the only connection of the limb to the assembly, save for the connection of the inboard limb end 28 of each limb to the riser assembly by an inelastic tether 39. When such a bow is at rest, the limbs are essentially unstressed along the elongate axis. Thus, as shown best in FIG. 10. for example, each limb has a front face 40 which carries a bracket 41 which, in the mounting of the limb to the riser assembly, includes a pair of trunions which are disposed on opposite sides of a gudgeon formed at the end of the riser assembly to project from the back face 24 of the assembly. A hinge pin 42 rotatably couples the trunions and the gudgeon. A rubber pad 45 is mounted between the bracket and the limb both on the front and rear faces of the limb to cushion the bracket and aid in developing uniform stress across the limb. Preferably the rubber pads are glued onto the limb under the bracket. In an alternate preferred embodiment, a plate made of aluminum or other stiff material may replace the rubber pad on the back face of the limb for holding the limb portions together as the limb flexes.

As shown in FIG. 2, the hingeable connections of the limbs 27 to riser assembly 21 are located at the mid-length of each limb. Accordingly, each limb is divided by the location of its mounting to the riser assembly into an outboard limb end 29, between the hinge axis and the outer tip of the limb, and an inboard limb end 28, between the hinge axis and the inner tip of the limb, and preferably are of uniform thickness along their length. However, as shown in FIG. 1, and in FIGS. 6–9, the limbs are of variable width, the widest part of the limb being at its mid-point where it is hinged to the riser assembly. A variation in width of the limb is defined so that, as the bow string is drawn in use of the bow, the limbs are stressed in longitudinal bending substantially uniformly along their lengths.

Figure 6:
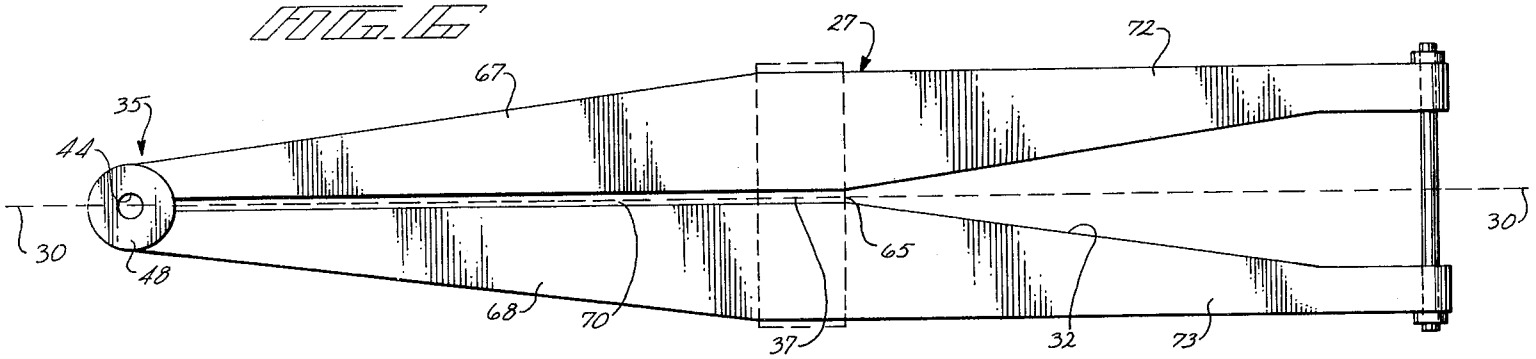
FIG. 6 is a plan view of a bow limb, according to this invention.
Figure 7:
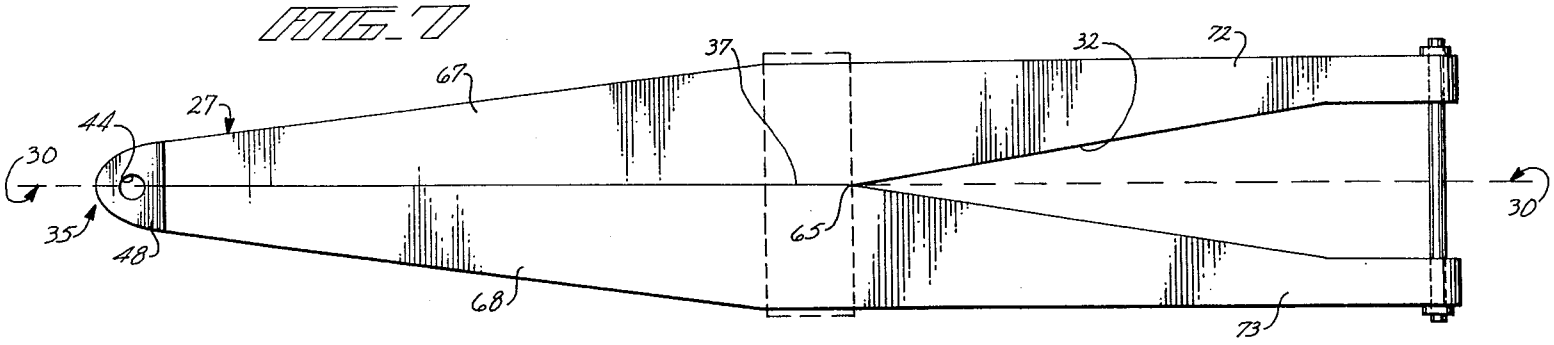
FIG. 7 is a plan view of an alternate preferred bow limb, according to this invention.
Figure 4:
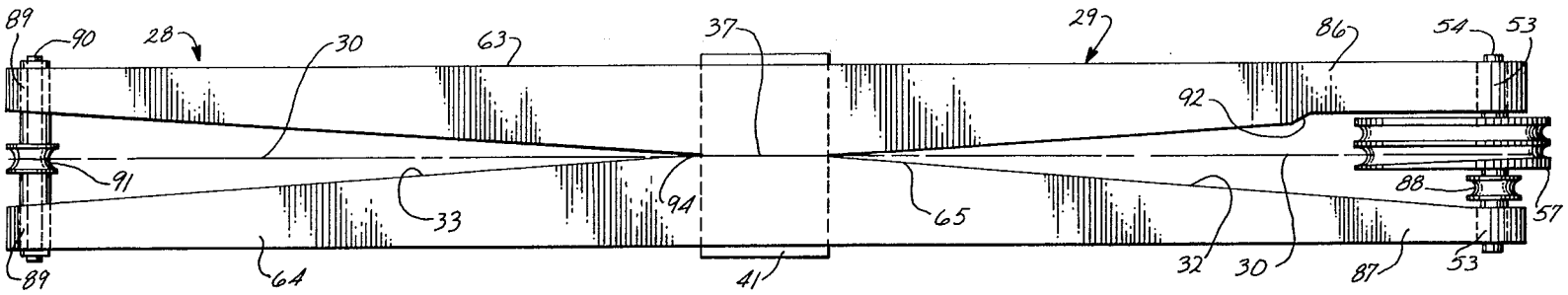
Figure 10:
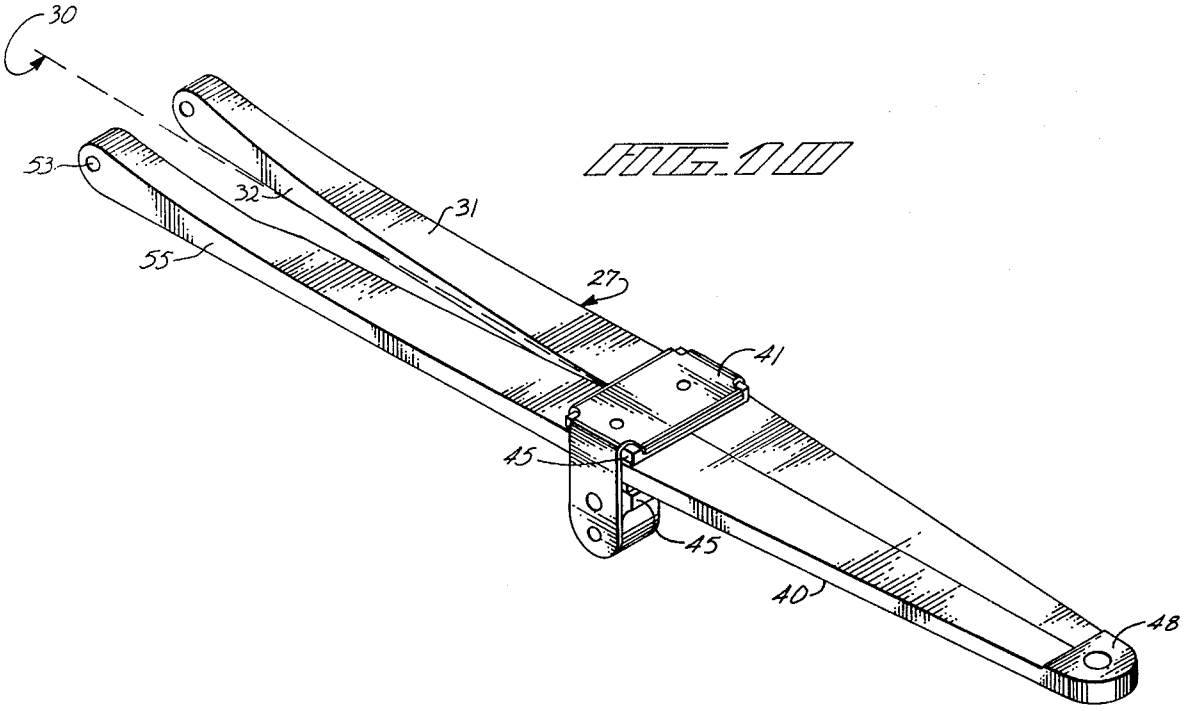
FIG. 10 is a perspective view of the preferred bow limb of FIG. 7.
Figures 16, 17, 18:
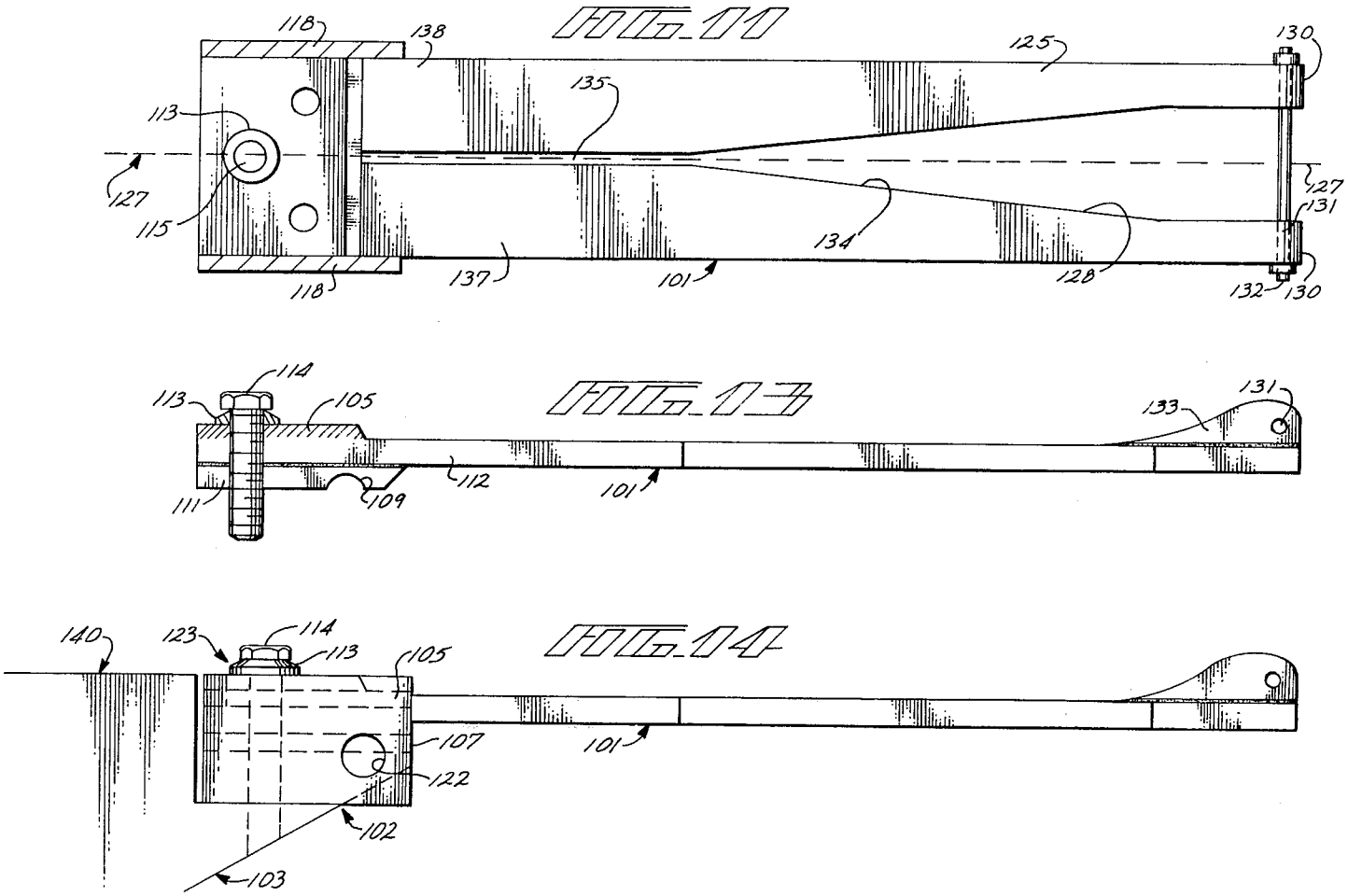

A tether 39 is connected between the inboard limb end 28 of each limb and the riser assembly at a location on the riser assembly adjacent to the inner limb tip. The primary purpose of the tethers is to constrain the inner limb tips from moving away from the riser assembly as the bow string is drawn. The tether adapts the inboard limb tip to be secured to the handle riser. The tethers are so constructed and so coupled to the limb innertips that the tethers impose upon the limb innertips no significant restraints against rotation of the limbs relative to the tethers. Preferably the tethers are defined by a loop of flexible metal cable which is enclosed in a smooth plastic sheath. The tether cable loops are preferably connected to the inner limb tips by passing the cable through a larger diameter passage 44 formed in the limb, preferably concentric with the limb elongate axis, adjacent the extreme inner end of the limb. Preferably, as shown in FIGS. 6, 7, and 10, the inner limb tip includes a pair of reinforcing plates 48 epoxied or otherwise suitably laminated to the forward and rear faces of the limb tip and drilled in place with the passage. Techniques for laminating bow limbs are well known to those skilled in the art and need no extensive elaboration here. The cable loop includes a stud which is received above the limb forward face by a hemispherical slotted bearing member 49 (see FIG. 1). Preferably the cable also passes under the bearing member through a rigid tip block 46, shown in FIG. 8, which has a shape that brackets the contour of the inboard limb tip and which has sides 47 which fit around the inboard limb tip and are about as thick as the limb at that location. The tip block constrains the limb portions to flex together at the tip of the inboard limb end. The other end of the tether passes through the riser assembly and is suitably secured to the front face of the riser.

The outboard limb end 29 is forked to define an outboard opening limb crotch 32 between a pair of limb tips 51. The limb tips define a passage 53 for receiving an axle 54. The axle passage is preferably defined through a built-up portion 55 of the limb tip which is suitably laminated to the remainder of the limb material. The axle rotatably mounts a pulley 57 for rotation about an axis disposed transversely of the elongate limb axis 30. Preferably the pulley axle is mounted perpendicular to the elongate limb axis. The passage 53, when receiving an axle, functions to constrain limb tips 51 at the outboard limb end to flex together.

Compound bow 20 in the presently preferred embodiment is of the two-wheel type in which a dead-end of a bus cable 59, opposite from its coupling hook 60, is connected to the axle of the eccentric pulley remote from its coupling hook; that is, the rigging cable which extends from a coupling hook at the top end of the bow as shown in FIG. 2, is reeved on and through the top eccentric pulley and has its opposite end 61 connected to the axle of the bottom eccentric pulley. The other cable is oppositely rigged. A shooting string 62 is connected between the coupling hooks. The pulley and rigging of the bow shown in FIGS. 1 and 2 is such that torsional forces acting on the limbs arising from rigging of the bus cables are essentially eliminated during drawing and release of the bow string. However, this invention may also be practiced on more conventional compound bows, such as are shown in U.S. Pat. No. 3,486,495.

The limb crotch accommodates the pulley which rotates eccentrically about the axle as the bow is drawn.

The material of the limb is split along the elongate axis from the inboard end of the crotch at location 65 for a substantial portion of the length of the limb toward the inboard end of the limb, and the limb mounting means. The splitting of the limb divides the limb into two limb portions 31 on opposite sides of the limb axis 30. The portion of the limb which is inboard of location 65 is divided into two inboard limb portions 67 and 68. Preferably the material of the limb is split along the elongate axis from the inboard end of the crotch for the entire portion of the length of the limb to the limb mounting means, such as is illustrated in FIG. 7, where the limb is split from the inboard end of the crotch at location 65 to the reinforcing strip 48 at the inboard tip of the limb.

FIGS. 6, 7, 8 and 9 illustrate four alternate preferred embodiments of the axially split limb of this invention, all intermediately mountable to a bow. FIG. 10 is a perspective of the limb in FIG. 7 and illustrates a preferred intermediate mounting bracket arrangement which is also used on the limbs of FIGS. 6, 8 and 9. In FIGS. 7 and 8, the limb is split along the elongate axis from the inboard end of the crotch, and inboard limb portions 67 and 68 abut each other in the relaxed state of the limb. In FIG. 6, the splitting of the limbs is enlarged to define a slot 70 along the elongate axis from the inboard end of the crotch to reinforcing strip 48. In FIG. 6, the inboard limb portions 67 and 68 do not touch each other along the slot when the bow limb is in its relaxed state and the bow is at rest. The limbs shown in FIGS. 6–8 vary in width so that, as the bow string is drawn in use of the bow, the limbs are stressed substantially uniformly along their lengths. Thus, the limbs shown in FIGS. 6–8 define a tapered crotch on the outboard side of the limb and tapered outer edges in the inboard side of the limb, that is, that portion of the limb inboard the intermediate limb location 37 for mounting the limb on pivot 38. Conversely, the outer side edges of the outboard limb ends in FIGS. 6–8 are parallel as are the inner side edges of inboard limb portions 67 and 68 along the elongate axis, (i.e., the split dividing the limb). Viewed from above, the preferred limb defines limb quarter portions which are of equal area on either side of the elongate limb axis and inboard and outboard of the intermediate limb location 37. Thus, in FIG. 7 outboard limb portion 72, which is defined as that portion of limb portion 31 which is outboard of intermediate location 37, preferably has the same area as outboard limb portion 73 defined on the other side of the crotch across the limb elongate axis. The same relation is true between inboard limb portions 67 and 68. Outboard limb portion 72 preferably has substantially the same area as does inboard limb portion 67 on the same side of the elongate axis. The same relation holds true for outboard limb portions 73 and corresponding inboard limb portions 68 of FIGS. 6 through 8.

Figure 5:
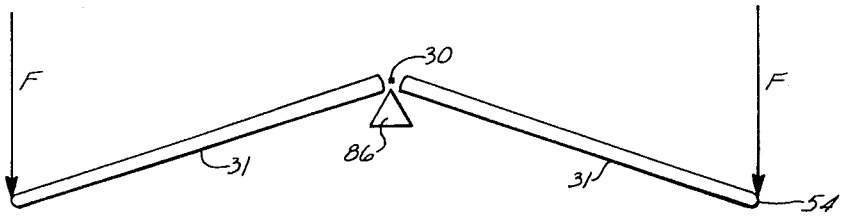
FIG. 5 is an end elevation of a bow limb, according to this invention, and taken along line 5—5 in FIG. 8.
Figure 4:
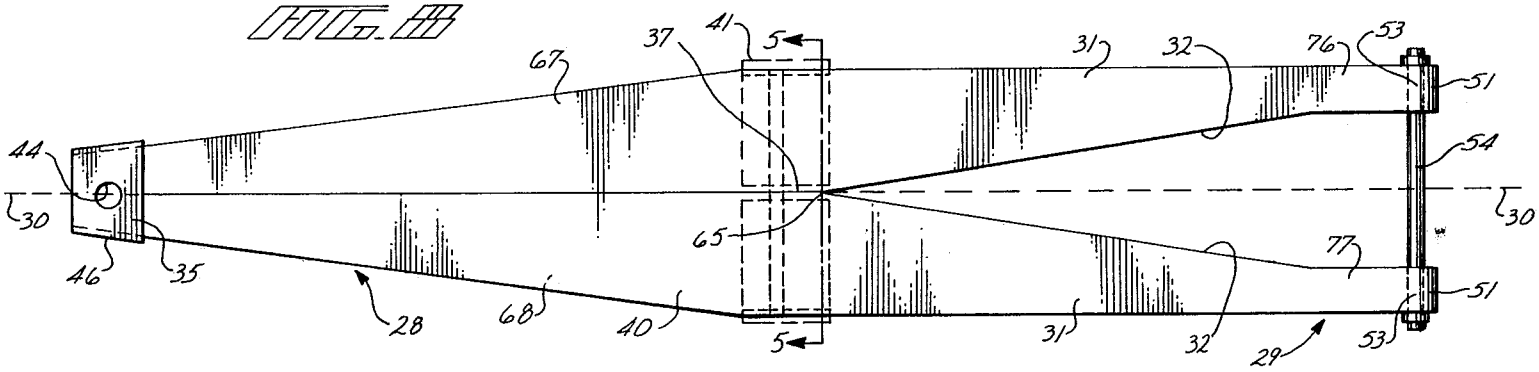

FIG. 5 is a diagram for analyzing a limb according to this invention, such as are shown in FIGS. 6–9, and taken along line 5—5 of FIG. 8. In FIG. 5, limb portions 31 lie on opposite sides of limb axis 30. The limb portions are coplanar when the bowstring is at its rest position. The limb material has a shear modulus in a plane normal to the elongate axis which is greater than its shear modulus in a plane parallel to the elongate axis. It is assumed that the limb in FIG. 5 has the same values of Young's modulus E as does the limb in FIG. 3.

When the limb of FIG. 8 is stressed by drawing the bowstring to apply force to the pulley axle 54, the force is transmitted to the limb at limb tips 51. The limb portions 31 flex along their length, i.e., in the longitudinal direction on either side of bracket 41. In contrast to the prior art limb of FIG. 3, which is analyzed in FIG. 4, the limb of FIG. 7 is split along elongate limb axis 30 from the inboard end 65 of the limb crotch to reinforcing strip 48. Although the incremental limb strips terminating in limb crotch 32 do not directly receive the limb flexing force, tensional stressing across the elongate limb axis does not build up because the limb is already split along that axis. Thus, in FIG. 5, the inboard end 65 of the limb crotch is represented by a fulcrum 86 and behaves like a knife edge of resistance along the limb elongate axis over which the limb may hinge. Due to the fact that interior strips of the limb terminate at the limb crotch, interior strips tend to resist the limb flexing force, labeled as vector arrows "F", received by the material at the outer edge of the limb. However, since the limb is split along the elongate axis for a substantial portion of its length, and preferably for the entire length of the limb, the limb is essentially "pre-cracked" and accomodates and yields to transverse tensional forces, which would otherwise accumulate to an objectionable extent across the limb axis in the back face of the limb at the inner end of the crotch.

The splitting of the limb allows each limb portion to accomodate stress independently of the other limb portion. During limb flexing, each limb portion tends to hinge about its inner edge relative to the at-rest configuration, when the limb portions are substantially coplanar and experience only the preload tension in the bow. The limb portions hinge about the elongate axis during flexing and tend to assume an inclined substantially planar geometry across the limb axis. However, since the pulley axle constrains the limb tips to remain coplanar, the degree of hinging or inclination varies in the longitudinal direction. As a result, the limb portions twist or flex to a limited extent in the transverse direction, although the magnitude of bowing is substantially reduced as compared to a prior art limb which is not axially split. In contrast to the bowed limb geometry shown in FIG. 4, a limb made according to this invention is effectively unstressed in the transverse direction, preferably perpendicular to the elongate axis, and will flex according to FIG. 5, essentially as though the limb were unsplit along its entire length. The tip block 46, the intermediate limb bracket 41, and the pulley axle 54 cooperate between the limb portions to hold the limb portions sufficiently together so that upon application of a limb flexing force to axle 54 received in passage 53, the limb portions 31 flex together essentially as though the limb were unsplit along its length. Each limb portion hinges to substantially the same extent as the other portion. The outer edges of the limb portions are vertically displaced to substantially the same extent, which inheres from the symmetry of the bow across the elongate axis.

This invention contemplates that a limb would be unsplit along its length if it were not forked to define a limb crotch. All material in such a limb would run the length of the limb from the limb mounting means at the inboard end uninterrupted to the pulley axle passage at the outboard limb tip and would directly receive the limb flexing force applied to the pulley axle. Such a limb would not experience bowing across the limb elongate axis due to termination of limb strips at a limb crotch and inability to relieve stress along the elongated axis. In other words, when a bow having such limbs is drawn, the limbs are effectively unstressed in the transverse direction, preferably perpendicular to the elongate axis. Such a limb is preferably incorporated in a bow where torsional forces arising from rigging of the pulleys is essentially eliminated during flexing of the bow and flexing of the limbs. If a bow limb according to this invention is used in a compound bow experiencing significant torsional stresses during drawing of the bowstring, the limb portions will tend to accomodate this torsion by bowing and not flexing together. This deviation in behavior, however, would occur in response to a problem different from that addressed by this invention, i.e., unbalanced rigging of the bus cables and shooting string about the limb's neutral axis of bending.

The preferred limbs illustrated in FIGS. 6–8 are intended for use in compound bow having intermediately pivoted limbs, such as is illustrated in FIGS. 1 and 2 and described in U.S. Pat. No. 4,183,345. In such a bow, the inboard limb end includes mounting means, shown best in FIG. 10, preferably a reinforcing strip, adapting the inboard limb end to be secured to the handle riser of the archery bow.

The limb pivots at intermediate limb location 37 around bracket 41. The bracket and the rubber pad 45 under it help constrain the limb portions to flex together by hinging so that the inner edge of one portion does not travel significantly away from the inner edge of the other portion. The bracket and pad cooperate between the limb portions at the intermediate location, as do the reinforcing plate 48 and the pulley axle at their respective locations along the limbs, for holding the limb portions sufficiently together so that upon application of the limb flexing force to an axle received in the axle passage, the limb portions flex together essentially as though the limb were not split along its length. Although the limbs shown in FIGS. 6–8 include cooperating means between the limb portions at three locations, it is only necessary to provide such cooperating means at at least one selected location along the limb portions.

FIG. 9 illustrates a fourth preferred embodiment of the axially split limb according to this invention. This limb has an outboard limb crotch and an inboard limb crotch and is intended to be used in a bow having intermediately pivoted limbs. The limb has a smaller inertial mass than do the split limbs of FIGS. 6–8 and can accelerate arrows to a greater velocity given the same drawing force. The limb is adapted to receive an appropriate mounting bracket 41, such as is illustrated in FIG. 10, at intermediate limb location 37, which divides the limb into an inboard limb portion 28 and an outboard limb portion 29. The outboard limb end is forked to define outboard limb tips 86 and 87. The outboard limb tips include an axle passage 53 for receiving an axle 54 which mounts eccentric pulley 57 and dead end loop pulley 88. The dead end loop pulley receives the dead end of a rigging bus cable of the bow, which preferably is seized to that pulley.

The inboard end of the limb is also forked to define an inboard limb crotch 33 between inboard limb portions 63 and 64. The limb tips define inboard axle passage 89 for receiving inboard axle 90 which mounts tether pulley 91. Preferably a loop of the inelastic tether 39 is seized to the tether pulley. In the embodiment of FIG. 9, the limb mounting means at the inboard limb end comprises the inboard axle passage 89 for receiving the inboard axle 90 and the tether pulley 91. Preferably the limb of FIG. 9 is symmetric about limb elongate axis 30 except for an eccentric pulley recess 92 defined in outboard limb tip 86 for receiving an eccentric pulley 57 having a large stroke. When the limb of FIG. 9 is rigged on a compound bow, preferably the tether pulley 91 is centered on the limb elongate axis to better distribute stress uniformly across the limb. For this purpose, preferably a plurality of spacing rings are provided on axle 90 on either side of the tether pulley. The pulley axles 54 and 90 cooperate between the limb portions to hold them together at the extreme ends of the limb. The bracket 41, along with its rubber pad 45, cooperate between the limb portions at the intermediate location for holding the limb portions sufficiently together so that, upon application of a limb flexing force to pulley axle 54, and resistance to flexing supplied along inboard axle 90 by the tether and the bracket, the limb portions flex together essentially as though the limb were unsplit along its length.

The limb in FIG. 9 is preferably symmetric about the bracket 41, so that the outboard limb crotch 32 terminates at location 65 adjacent the bracket, and inboard limb crotch 33 terminates at location 94 at the inboard end of the bracket. A symmetric limb best provides a uniform distribution of stress. The outer edges of the limb portions are parallel, while the inner edges defining limb crotches 32 and 33 are tapered.

When a limb according to this invention is intermediately mounted on a bow, such as in FIGS. 1 and 2, preferably the limb crotch is defined sufficiently deep so that its inboard end at location 65 is located at the outboard end of bracket 41 covering the intermediate hinging location 37. The bracket 41 then spans the limb at the place where the middle strips terminate, i.e., just inboard of the limb crotch.

The bracket resists limb cracking by pushing down on the material in the middle of the limb which tends to rise as it resists limb flexing. The bracket holds the limb portions sufficiently together at the midpoint of the limb so that the limb portions flex together essentially as though the limb were unsplit along its length. The bracket provides interference to prevent the limb portions from running away from each other. In the limb of FIG. 9, the bracket spans the limb preferably over the entire region between the outboard and inboard crotches. The cooperative function of holding the limb portions together is essential because a significant percentage of the strips run from crotch to crotch and do not extend to either pulley axle.

Figure 11:
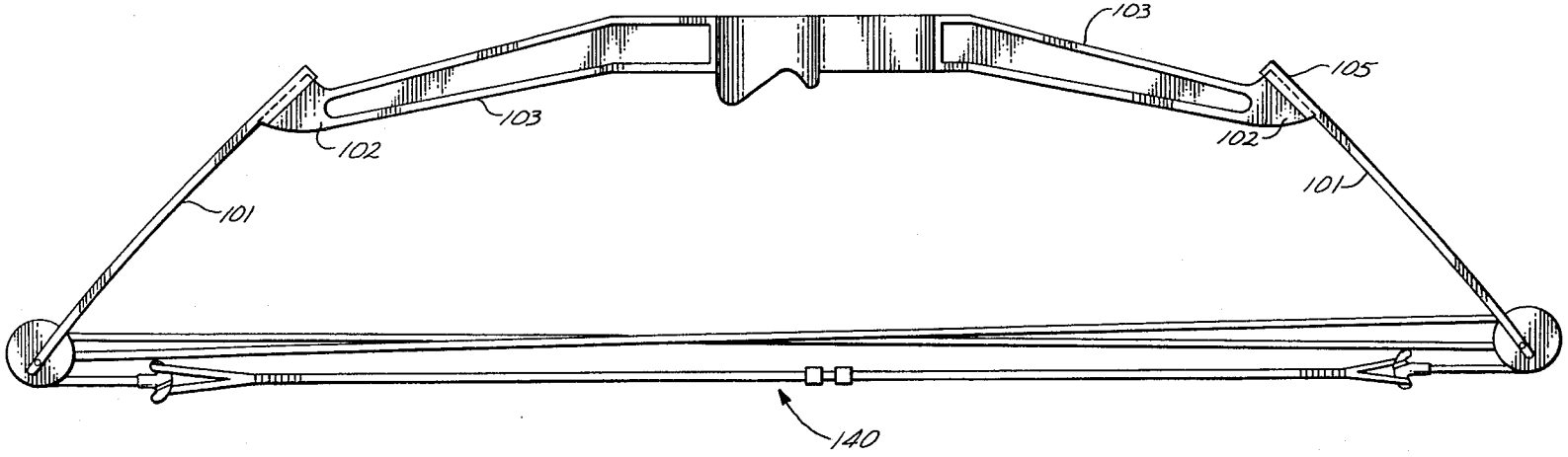
FIG. 11 is a plan view of a bow limb, according to this invention, for use in an archery bow using cantilever-mounted limbs.
Figure 15:
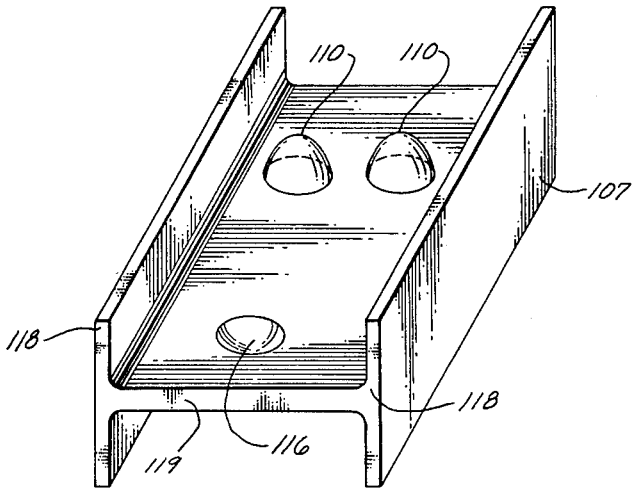
FIG. 15 is a perspective of a mounting bracket for mounting the bow limb of FIG. 11 to a bow as in FIG. 12, according to this invention.

FIG. 11 is a preferred embodiment of the limb according to this invention for use in compound bows, such as are shown in FIG. 12, where the limbs are not intermediately mounted, as in FIGS. 1 and 2, but are more conventionally mounted and flex essentially as cantilever-supported limbs. Thus, as shown in FIG. 14, a limb 101 is secured to the end 102 of a riser assembly 103 at inboard limb end 105. The limb is secured to the riser by mounting to an "H" shaped bracket 107, shown in FIG. 15, which is secured to the end of the riser assembly. The underside or front face of the limb inboard end includes a pair of hemispherical sockets 109 for receiving corresponding hemispherical protrusions 110 carried on the upper side of the "H" bracket. The protrusions act as a pivot point to permit adjustment of the limb on the handle riser. Preferably the hemispherical sockets are defined in the limb in a reinforcing layer 111 which is mounted to the limb inboard end underneath the main plane 112 of the limb. In this manner, the sockets may be included without interfering or disrupting the material running from the inboard to the outboard ends of the limb which flexes when the limb is drawn. The reinforcing layer 111 is epoxied or otherwise suitably laminated to the underside of the limb inboard end 105.

A rigid adjustment screw 114, preferably self-threading, passes through the limb and the "H" bracket along, respectively, passages 115 and 116 and is secured to the handle riser of the bow. The screw 114, cooperating with the pivot-like fit of hemispherical protrusions into their corresponding sockets, permits adjustment of the weight of the bow. Preferably, a rigid metal plate 113 is secured under the adjustment screw to clamp the inboard limb portions together. Alternately, the limbs may be directly bolted to the web of the "H" bracket, or a rocker assembly may secure the limbs to the riser assembly. The "H" bracket is preferably formed from an aluminum extrusion and includes integrally formed sides 118 extending above and below a web 119. Above the web the sides are preferably separated by the width of the inboard end of the limb and provide angular interference for rigidly mounting the inboard end of the limb to the handle riser to prevent rotation of the limb about its inboard connection to the riser. Under the web the sides register with the handle riser to similarly constrain the limb mounting assembly. The "H" bracket and limb assembly is further secured to the handle riser by a rigid fastener at passage 122 defined through a side wall of the "H" bracket. The assembly shown in FIGS. 11–15 illustrates a limb mounting means 123 at the inboard limb end adapting the limb of FIG. 11 to be adjustably secured to the handle riser of an archery bow as a cantilever-supported limb.

The limb in FIG. 11 also includes an outboard end 125. The outboard end is forked across elongate limb axis 127 to define an outboard-opening limb crotch 128 between limb tips 130. The limb tips include a passage 131 for receiving an axle 132 for mounting a pulley transversely to the elongate limb axis 127. Preferably, the pulley is mounted perpendicular to the elongate axis of the limb. The bow 140, the riser of which is partially illustrated in FIG. 14, is preferably a compound bow utilizing an eccentric pulley such as is shown and described in pending U.S. application Ser. No. 115,954, filed Jan. 28, 1980. The pulley and rigging of such a bow is such that torsional forces acting on the limbs arising from unbalanced bus cable rigging are effectively eliminated during drawing and release of the bow string. However, the preferred limb shown in FIG. 11 may also be practiced on other compound bows using more conventional rigging schemes such as, for example, are shown in U.S. Pat. No. 3,486,495.

The outboard limb tips preferably include a reinforcing strip 133 defining axle passage 131. Reinforcing strips 133 are preferably bonded to the limb tips by suitable lamination methods so that the limb tips and the reinforcing material act as one unit. It is preferable to incorporate the reinforcing strip so that the axle passage may be included without disrupting or interrupting the limb material running along the plane of the limb which flexes when the bow is drawn.

The limb of FIG. 11 is axially split along the elongate axis from the inboard end 134 of the limb crotch for a substantial portion of the length of the limb toward the limb mounting means at the inboard end of the limb. The location of crotch end 134 is preferably chosen to achieve uniform stress distribution across the limb. The inboard end of the crotch is preferably located about midway between the limb mounting means and the pulley axle so that the flexing areas of the limb, inboard and outboard of the crotch end 134, on either side of the elongate axis, are substantially equal. The limb defines an axial slot 135 along the limb elongate axis, which corresponds to axial slot 70 defined in the intermediately pivoted limb shown in FIG. 6. However, a cantilever-supported limb according to this invention need not include slot 135 but may instead be simply split from the inboard end of the crotch for a substantial portion of the length of the limb toward the limb mounting means, analagous to the splitting of the intermediately pivoted limbs shown in FIGS. 7 and 8. The slot shown in FIG. 11 divides the limb into two portions 137 and 138 on opposite sides of the limb elongate axis.

The mounting arrangement at the inboard end of the cantilever-supported-type limb, that is, the fastener 114 and the "H" bracket 107, cooperates with the limb portions at the inboard end by holding the limb portions together. Pulley axle 132 holds the limb portions together at the outboard end of the limb. The inboard mounting and the pulley axle cooperate between the limb portions for holding the limb portions sufficiently together so that, upon application of a limb flexing force to the axle received in passage 131, the limb portions flex together essentially as though the limb were unsplit along its length. Thus, the new cantilever-supported limb will display the flexing characteristics illustrated in FIG. 5, and previously discussed with reference to the intermediately pivoted limb of FIG. 8. The cantilever-supported limb of FIG. 11 will not flex significantly in the transverse direction, which is preferably perpendicular to the limb elongate axis. Although this limb includes a crotch, so that limb material terminating inside the crotch does not directly receive the limb flexing force, the limb is axially split and hinges so that the stress is relieved along the slot before stress can build up or concentrate objectionably across the limb portions.

The cantilever-supported limb of FIG. 11 is preferably symmetrical about the limb elongate axis so that limb portions 137 and 138 are of equal area and the limb has a uniform stress distribution on either side of the elongate axis. Preferably the limb portions are also symmetrical lengthwise about the inboard end 134 of the limb crotch so that the limb achieves a substantially uniform distribution of stress along its length.

This invention has been described above with reference to presently preferred embodiments of the invention; such description has not been presented as a catalog exhaustive of all forms which bows or bow limbs according to this invention may take. Accordingly, workers skilled in the art to which this invention pertains will readily appreciate that variations, alterations or modifications in the structures, procedures, and arrangements described above may be practiced without departing from the scope of this invention. Thus, the foregoing description should not be read as limiting the scope of this invention to less than the fair scope of the following claims.

What is claimed is:

1. An elongate resilient limb for a compound archery bow, the limb defining an outboard limb end and an inboard limb end at opposite ends of an elongate limb axis;

the limb including mounting means disposed along the length of the limb in spaced relation to the limb outboard end adapting the limb to be secured to a handle riser of the archery bow;

the outboard limb end being forked to define an outboard opening crotch between a pair of limb tips, the crotch coming to a taper across the elongate axis at a location intermediate the outboard and inboard limb ends, the limb tips defining a passage for receiving an axle for mounting a pulley perpendicular to the elongate axis of the limb;

the material of the limb being split along the elongate axis from the inboard end of the crotch taper for a substantial portion of the length of the limb toward the limb inboard end thereby to divide the limb into two portions on opposite sides of the axis; and means cooperating between said limb portions at at least one selected location toward the limb inboard end from the crotch for holding said limb portions sufficiently together so that, upon application of a limb flexing force to an axle received in the passage, the limb portions flex together essentially as though the limb were unsplit along its length.

2. The limb according to claim 1 wherein the limb comprises material having a shear modulus in a plane normal to the elongate axis which is greater than its shear modulus in a plane parallel to the elongate axis.

3. The limb according to claim 1 wherein the limb experiences a uniform distribution of stress along its length upon application of the limb flexing force.

4. The limb according to claim 1 wherein the limb portions are of equal area.

5. The limb according to claim 1 wherein the inboard end of the crotch divides each limb portion into an inner limb portion which is inboard of the crotch and an outer limb portion, where such corresponding inner and outer limb portions each have an effective flexing area, such effective flexing areas being equal.

6. The limb according to claim 1 wherein the limb is symmetric about the elongate axis.

7. The limb according to claim 1 wherein the limb is symmetric about a line perpendicular to the elongate axis and intersecting the inboard end of the crotch.

8. The limb according to claim 1 wherein the limb portions are effectively unstressed in a direction perpendicular to the elongate axis upon the application of the limb flexing force.

9. The limb according to claim 1 wherein the limb is intermediately mounted to the bow whereby the mounting means comprises hinging means, connecting the limb, at a location which is intermediate that portion of the limb's length which is resilient, to the respective end of the handle riser for hinging motion of the limb relative to the assembly upon the application of the limb flexing force, the limb having an inner tip adjacent a front face of the handle riser proximate the handle, and tether means connected between the limb inner tip and the handle riser, for constraining the inner tip from movement linearly relative to the assembly in response to the application of the limb flexing force, during which the limb experiences substantial flexing at locations therealong on opposite sides of the location of connection of the limb to the riser assembly, for storage of substantial energy in the limb on opposite sides of the location.

10. The limb according to claim 9 wherein the cooperating means comprises a bracket spanning the limb at the intermediate location.

11. The limb according to claim 10 wherein the inboard end of the crotch abuts the outboard edge of the bracket.

12. The limb according to claim 9 wherein the limb is split along its elongate axis from the inboard end of the crotch to the tether means.

13. The limb according to claim 1 wherein the splitting of the limb defines a slot concentric with the elongate axis.

14. The limb according to claim 9 wherein the pulley is mounted to the axle and rigged so that, upon the application of the limb flexing force, the limb experiences essentially no torsion arising from unbalanced rigging of bus cables reeved on the pulley.

15. The limb according to claim 9 wherein the inboard end of the limb is forked to define an inwardly opening limb crotch between a pair of inner limb tips.

16. The limb according to claim 1 wherein the limb is mounted to the bow as a cantilever-supported limb.

17. The limb according to claim 16 wherein the mounting means comprises an H-shaped bracket comprising a web integrally formed perpendicular to a pair of opposite sides extending above and below the web.

18. A compound archery bow comprising;

a rigid elongate handle riser assembly having opposite ends and a handle portion;

an elongate resilient limb at one of the ends of the assembly, the limb defining an outboard limb end and an inboard limb end at opposite ends of an elongate limb axis, the inboard limb end including mounting means adapting such limb end to be secured to an end of the handle riser assembly, the outboard limb end being forked to define an outboard opening crotch between a pair of limb tips, the crotch coming to a taper across the elongate axis at a location intermediate the outboard and inboard limb ends, the limb ends defining a passage for receiving an axle for mounting a pulley perpendicular to the elongate axis of the limb, the material of the limb being split along the elongate axis from the inboard end of the crotch taper for a substantial portion of the length of the limb toward the limb inboard end thereby to divide the limb into two portions on opposite sides of the axis;

a bow string coupled between the pulley received between the limb tips and the other end of the bow adjacent to a rear face of the assembly, the bow string having a nocking point adapted to be drawn from a rest position to a drawn, limb-flexing position upon application of drawing force thereto; and means cooperating between said limb portions at at least one selected location toward the limb inboard end from the crotch for holding said limb portions sufficiently together so that, upon the application of the drawing force, the limb portions flex together essentially as though the limb were unsplit along its length.

19. The compound archery bow according to claim 18 wherein, upon the application of the drawing force, and flexing of the limbs, the limb portions are effectively unstressed in a direction perpendicular to the elongate axis.

* * * * *

UNITED STATES PATENT AND TRADEMARK OFFICE

CERTIFICATE OF CORRECTION

PATENT NO. : 4,350,138

DATED : September 21, 1982

INVENTOR(S) : Joseph M. Caldwell

It is certified that error appears in the above-identified patent and that said Letters Patent are hereby corrected as shown below:

Column 2, line 42, "blow" should be -- bow --. Column 4, line 53, after "to" and before "78" insert -- pulley axle passage --. Column 5, line 19, "of" should read -- or --.

Signed and Sealed this

Seventh Day of December 1982

[SEAL]

*Attest:*

GERALD J. MOSSINGHOFF

*Attesting Officer*

*Commissioner of Patents and Trademarks*